United States Patent [19]

Haneda et al.

[11] Patent Number: 4,558,293

[45] Date of Patent: Dec. 10, 1985

[54] SOLENOID ASSEMBLY

[75] Inventors: Hideo Haneda; Minoru Yamanaka, both of Toyota, Japan

[73] Assignee: Aisin Seiki Kabushiki Kaisha, Aichi, Japan

[21] Appl. No.: 554,667

[22] Filed: Nov. 23, 1983

[30] Foreign Application Priority Data

| | | | |
|---|---|---|---|
| Nov. 25, 1982 | [JP] | Japan | 57-206441 |
| Nov. 25, 1982 | [JP] | Japan | 57-206442 |
| Nov. 25, 1982 | [JP] | Japan | 57-206443 |
| Nov. 25, 1982 | [JP] | Japan | 57-206440 |

[51] Int. Cl.[4] ..... H01F 7/08

[52] U.S. Cl. ..... 335/255; 335/260; 335/278; 310/30

[58] Field of Search ..... 335/251, 255, 256, 278, 335/229, 230; 310/15, 30, 33, 34, 35, 24, 156, 152, 14, 12

[56] References Cited

U.S. PATENT DOCUMENTS

| | | | |
|---|---|---|---|
| 3,331,042 | 7/1967 | Erickson et al. | 335/260 |
| 3,504,315 | 3/1970 | Stanwell | 335/234 |
| 3,727,160 | 4/1973 | Churchill | 335/278 X |
| 4,236,131 | 11/1980 | Grandclement | 335/260 |
| 4,290,039 | 9/1981 | Tochizawa | 335/251 X |
| 4,363,980 | 8/1981 | Petersen | 310/15 |
| 4,479,162 | 10/1984 | Offutt et al. | 335/255 |

*Primary Examiner*—Donovan F. Duggan

*Attorney, Agent, or Firm*—Sughrue, Mion, Zinn, Macpeak & Seas

[57] ABSTRACT

A solenoid assembly comprising a magnetic plunger, an electric coil for generating a magnetic flux in a direction along an axis of the magnetic plunger, a main yoke composed of at least two separate members for defining a magnetic flux passage around the electric coil, and a pair of yoke end members held in engagement respectively with opposite ends of the main yoke, an outer casing. The yoke end members have recesses extending substantially normally to the axis of the magnetic plunger, and the main yoke has projections fitted respectively in the recesses to maintain the main yoke and the yoke end members in engaging relationship. The outer casing has an inner wall keeping the main yoke held in engagement with the yoke end members. A leaf spring acts on the main yoke to hold the latter securely in place in the outer casing. The yoke end members have cylindrical projections supporting thereon the electric coil between the projections of the main yoke. Magnetic cores are firmly held against a permanent magnet by resilient members fitted in slots defined in outer peripheral surface of a plunger shaft.

19 Claims, 7 Drawing Figures

SOLENOID ASSEMBLY

BACKGROUND OF THE INVENTION

The present invention relates to a solenoid assembly for driving an actuator in response to energization of electric coils.

Prior solenoid assemblies have plunger cores mounted in position on a shaft by E-rings. Due to dimensional errors, however, the plunger cores tend to wobble and produce noise, and the E-rings may not be mounted in place. A permanent magnet incorporated in the solenoid assembly may be defective as it is difficult to machine with desired dimensional accuracy. Swaging the plunger cores on the shaft is liable to damage the permanent magnet under compressive forces, and tedious and time-consuming. Yoke end members, coil bobbins, a central plate, and a main yoke are assembled together by swaging the main yoke on the yoke end members. However, the swaging process results in widely different dimensional errors of fabricated solenoid assemblies. The coil bobbins should be of an increased thickness to withstand swaging forces acting thereon, but the thick coil bobbins would render the solenoid assembly larger in diameter.

SUMMARY OF THE INVENTION

It is an object of the present invention to provide a solenoid assembly which allows plunger cores to be mounted on a shaft relatively easily and requires relatively low dimensional accuracies.

Another object of the present invention is to provide a small-size solenoid assembly.

Still another object of the present invention is to reduce dimensional variations in fabricated solenoid assemblies.

Still another object of the present invention is to provide a solenoid assembly in which parts are assembled without employing any swaging procedure.

A still further object of the present invention is to provide a solenoid assembly having no coil bobbins.

A still further object of the present invention is to provide a solenoid assembly which can be assembled with ease.

According to the present invention, a main yoke is composed of a plurality of separate members, and either the main yoke or yoke end members have recesses defined substantially normally to the axis of a plunger with the other having projections fitted in the recesses to keep the main yoke and the yoke end members held in mutually engaging relationship by an inner wall of an outer casing which supports the main yoke. In an embodiment of the present invention, the main yoke is composed of two members separated by a plane including a central axis of the main yoke. Each yoke member has on opposite ends thereof projections defining semicircular openings, and each yoke end member an annular recess or groove defined in an outer peripheral surface thereof and receiving the peripheral edge of the semicircular opening. The semicircular peripheral edges of the projections of the two yoke members are inserted respectively in the annular slots, thereby providing a yoke assembly forming a magnetic flux passage around an electric coil. The yoke assembly is inserted in an outer casing of synthetic resin having therein a space complementary to the outer profile of the yoke assembly.

At least one of the yoke members is urged by a spring member toward the other yoke member to keep the main yoke and the yoke end members held in mutual engagement. The spring member comprises a partly cylindrical leaf spring curved in its free state. The yoke assembly and the leaf spring are inserted in the outer casing with the leaf spring forcibly flattened in an additional gap in the outer casing. The yoke assembly is thus held together by an inner wall of the outer casing and the leaf spring.

Each of the yoke end members has a cylindrical projection supporting a portion of the electric coil which is disposed radially outwardly of the cylindrical projection and between the projections on the ends of the main yoke. The electric coil disposed between the projections on the ends of the main yoke comprises a fixedly shaped coil composed of an insulated wire coated with thermally fusible insulating resin and thermally treated.

With the foregoing arrangement, magnetic loop gaps such for example as yoke end member gaps are determined by the combination of the main yoke and the yoke end members, resulting in fewer and reduced variations in manufactured solenoid assemblies. Since no coil bobbin is employed, the solenoid assembly can be assembled with ease. The yoke assembly is secured held in position by the leaf spring against undesired wobbling movement. Since the coil is subjected to no assembling forces such as staking forces, it is protected against damage or deformation even with no coil bobbin employed. As the coil is located closely to a plunger because of no bobbin, a magnetic field acting on the plunger is increased. The solenoid assembly of the invention can be reduced in diameter at least by the thickness of any bobbin which would otherwise be incorporated.

Resilient members of relatively hard material are fitted in recesses in a plunger shaft to support plunger cores. The resilient members can relatively easily be mounted on the shaft even if they have somewhat large dimensional errors, and prevent the plunger cores from wobbling on the shaft. The resilient members may be utilized as damper members, thereby keeping the number of parts used to a minimum.

The above and other objects, features and advantages of the present invention will become more apparent from the following description when taken in conjunction with the accompanying drawings in which a preferred embodiment of the present invention is shown by way of illustrative example.

BRIEF DESCRIPTION OF THE DRAWINGS

FIG. 2*c* is another side elevational view of the solenoid assembly shown in FIG. 2*a.

DETAILED DESCRIPTION

Figure 1:
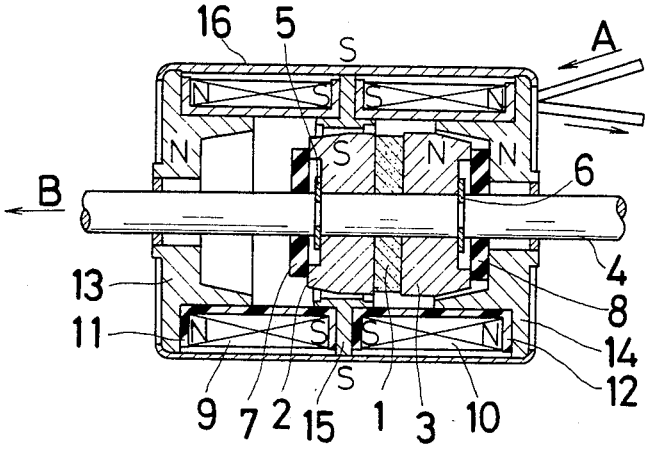
FIG. 1 PRIOR ART
FIG. 1 is a longitudinal cross-sectional view of a conventional solenoid assembly.

FIG. 1 illustrates one conventional type of a solenoid assembly including a disk-shaped permanent magnet 1 of ferrite with its side magnetized as S and N poles and a pair of frustoconical magnetic plunger cores 2, 3 disposed one on each side of the disk-shaped permanent magnet 1. The magnetic plunger cores 2, 3 are held against the permanent magnet 1 by a pair of E-rings 5, 6 fitted in annular slots in a shaft 4 extending axially through the permanent magnet 1 and the magnetic plunger cores 2, 3. The shaft 4 also extends through damper disks 7, 8 of rubber positioned outside of the E-rings 5, 6.

Electric coils 9, 10 are wound respectively around coil bobbins 11, 12 supported on a magnetic yoke end plate 13 and a central magnetic plate 15 and on a magnetic yoke end plate 14 and the central magnetic plate 15, respectively, and accommodated in a cylindrical magnetic casing or main yoke 16. The cylindrical casing 16 has opposite ends swaged radially inwardly on the magnetic yoke end members 13, 14 to keep the yoke end plate 13, the coil bobbin 11, the central plate 15, the coil bobbin 12, the yoke end plate 14, and the cylindrical casing 16 securely in assembled condition.

When an electric current flows in the direction of the arrow A through wires connected to the coils 9, 10, the yoke end members 13, 14 are magnetized as N poles and the central plate 15 is magnetized as an S pole. The permanent magnet 1 has S and N poles on its lefthand and righthand sides (as shown), respectively, and the plunger cores 2, 3 are magnetized respectively as S and N poles at all times. With the current flowing in the direction of the arrow A, the plunger core 2 is axially moved in the direction of the arrow B by being attracted to the yoke end member 13 and simultaneously repelled from the central plate 15, and at the same time the plunger core 3 is also axially moved in the direction of the arrow B by being repelled from the yoke end member 14 and simultaneously attracted to the central plate 15. The shaft 4 is now axially moved also in the direction of the arrow B until the damper disk 7 abuts against the yoke plate 13. After the shaft 4 has been moved to the left in the direction of the arrow B, a current is passed through the wires in a direction opposite to the direction of the arrow A, whereupon the yoke end members 13, 14 are magnetized as S poles and the central plate 15 is magnetized as an N pole. The shaft 4 is then axially moved leftward in a direction opposite to the direction of the arrow B until it reaches the position shown in FIG. 1.

The prior solenoid assembly as described above is used, for example, as a driver for automatically locking and unlocking a vehicle door.

The solenoid assembly of the construction as illustrated in FIG. 1 is however disadvantageous in that the plunger cores 2, 3 may wobble and produce noise or the E-rings 5, 6 may not be mounted in position due to dimensional errors of the plunger cores 2, 3, the shaft 4, and the E-rings 5, 6. Furthermore, it is difficult to achieve a desired degree of dimensional accuracy for the permanent magnet 1 and hence it is highly probable that defective permanent magnets will be fabricated.

To avoid such a difficulty, it has been practiced to affix the plunger cores 2, 3 to the shaft 4, without employing the E-rings, by swaging on the shaft 4 outer end edges of holes in the plunger cores 2, 3 through which the shaft 14 extends. This swaging process may however damage the perpament magnet 1 under compressive forces, and is tedious and time-consuming.

The solenoid assembly construction as shown in FIG. 1 has other problems. Specifically, the gap between the yoke end members 13, 14, that is, the gap between the yoke end member 13 and the central plate 15 and the gap between the yoke end member 14 and the central plate 15 are determined by the dimensions of the yoke end members 13, 14, the coil bobbins 11, 12, the cylindrical casing or main yoke 16, and the central plate 15, and also by the strength and direction of the swaging of the ends of the main yoke 16. This indicates that there are many parameters which affect the gaps and solenoid assemblies produced suffer from widely different dimensional errors due primarily to the swaging process. The coil bobbins 11, 12 must have an increased thickness to withstand swaging forces, and thus the solenoid assembly has an increased diameter. With the increased thickness of the coil bobbins 11, 12, the magnetic field produced by the coils 9, 10 and acting on the plunger cores 2, 3 is weakened and should be strengthened by increasing the number of turns of the coils 9, 10 or the diameter thereof. Therefore, the increased thickness of the coil bobbins 11, 12 results in not only an increased solenoid assembly diameter, but also more turns of the coils 9, 10 which in turn increases the solenoid assembly diameter. Reducing the thickness of the coil bobbins 11, 12 is therefore highly effective in rendering the solenoid assembly smaller in size.

A solenoid assembly according to the present invention will be described with reference to FIGS. *2a–2c* and *3a–3c*. The illustrated solenoid assembly is designed for use as a driver for automatically locking and unlocking a vehicle door.

As illustrated in FIG. *2a*, a shaft 4 has annular slots $4_1$, $4_2$ axially spaced from each other and positioned on opposide sides of a plunger supporting portion $4_3$. The shaft 4 has the plunger supporting portion $4_3$ and portions $4_4$, $4_5$ which are defined by the annular slots $4_1$, $4_2$ and of the same diameter greater than that of the annular slots $4_1$, $4_2$. A pair of disks 7 made of relatively hard rubber is mounted respectively in the annular slots $4_1$, $4_2$. When the rubber disks 7 are in their free state prior to being mounted on the shaft 4, the diameter of holes in the rubber disks 7 is smaller than that of the shaft portions $4_3$, $4_4$, $4_5$, and is substantially the same as or slightly smaller than that of the annular slots $4_1$, $4_2$.

For assembly, the shaft 4 is forcibly inserted through the hole in the rubber disk 8 until the latter is fitted in the annular slot $4_2$. The shaft 4 is then threaded successively through central holes in a plunger core 3, a permanent magnet 1 made of rare earth magnetic material, for example, a plunger core 2, and the rubber disk 7 in the order named. The rubber disk 7 is firmly pressed against the plunger core 2 until the rubber disk 7 is fitted into the annular slot $4_1$. Thus, an assembled shaft and plunger combination as shown in FIGS. *2a* and *3a* is provided. In the illustrated embodiment, the plunger supporting portion $4_3$ has an axial length slightly smaller than the total thickness of the plunger core 3, permanent magnet 1, and plunger core 3, and the rubber disks 7, 8 have a thickness equal to the width of the annular slots $4_1$, $4_2$. Accordingly, when the shaft and plunger combination is assembled as illustrated in FIGS. *2a* and *3a*, the rubber disks 7, 8 are placed in a state of compression by the plunger cores 2, 3, making the permanent magnet 1 and the plunger cores 2, 3 tightly assembled together against any undesired wobbling movement relative to the shaft 4.

As shown in FIG. *2a*, the shaft 4 extends axially through a pair of axially spaced yoke end members 13, 14 of a cup shape interconnected by a pair of main yoke bodies 17, 18 (see also FIG. *3b*). The main yoke bodies 17, 18 have central transversely oblong apertures $17_1$, $18_1$ as shown in FIG. 3*b* in which there are inserted diametrically opposite projections of a central plate 15 as illustrated in FIG. 2*a*, the central plate 15 being also shown in FIG. 3*a*. As shown in FIG. 3*b*, the main yoke bodies 17, 18 have locking fingers $17_2$, $17_3$ and $18_2$, $18_3$, respectively, defining semicircular openings at opposite ends thereof. The locking fingers $17_2$, $17_3$ and $18_2$, $18_3$ are fitted in annular grooves (FIGS. 2*a* and 3*a*) defined in outer circumferential surfaces of the yoke end members 13, 14. More specifically, the yoke end members 13, 14 are held in position in axially confronting relation by the main yoke bodies 17, 18 with the locking fingers $17_2$, $18_2$ being held against each other at distal ends thereof and the locking fingers $17_3$, $18_3$ being held against each other at distal ends thereof. The locking fingers $17_2$, $18_2$ and $17_3$, $18_3$ now define circular openings in which the annular grooves in the yoke end members 13, 14 are positioned, respectively. More specifically, the locking fingers $17_2$, $18_2$ are received in the annular groove in the yoke end member 13, and the the locking fingers $17_3$, $18_3$ are received in the annular groove in the yoke end member 14. The yoke end members 13, 14 are therefore kept axially spaced from each other by a predetermined distance.

As shown in FIG. 2*a*, a first electric coil 9 is disposed radially outwardly around the yoke end member 13 and accommodated axially between the locking fingers $17_2$, $18_2$ and the central plate 15, and likewise a second electric coil 10 is disposed radially outwardly around the yoke end member 14 and accommodated axially between the locking fingers $17_3$, $18_3$ and the central plate 15. It should be noted here that there are no coil bobbins for supporting the coils 9, 10 thereon.

The electric coils 9, 10 are shown in FIG. 3*b*. Each of the coils 9, 10 is manufactured by winding an insulated wire coated with a thermally fusible insulating resin around a bobbin coated with a release agent, heating the wound wire, and then removing the wound wire after it has been cooled. The coils 9, 10 retain their configuration as shown in FIG. 3*b* under normal condition.

Figure 2A:
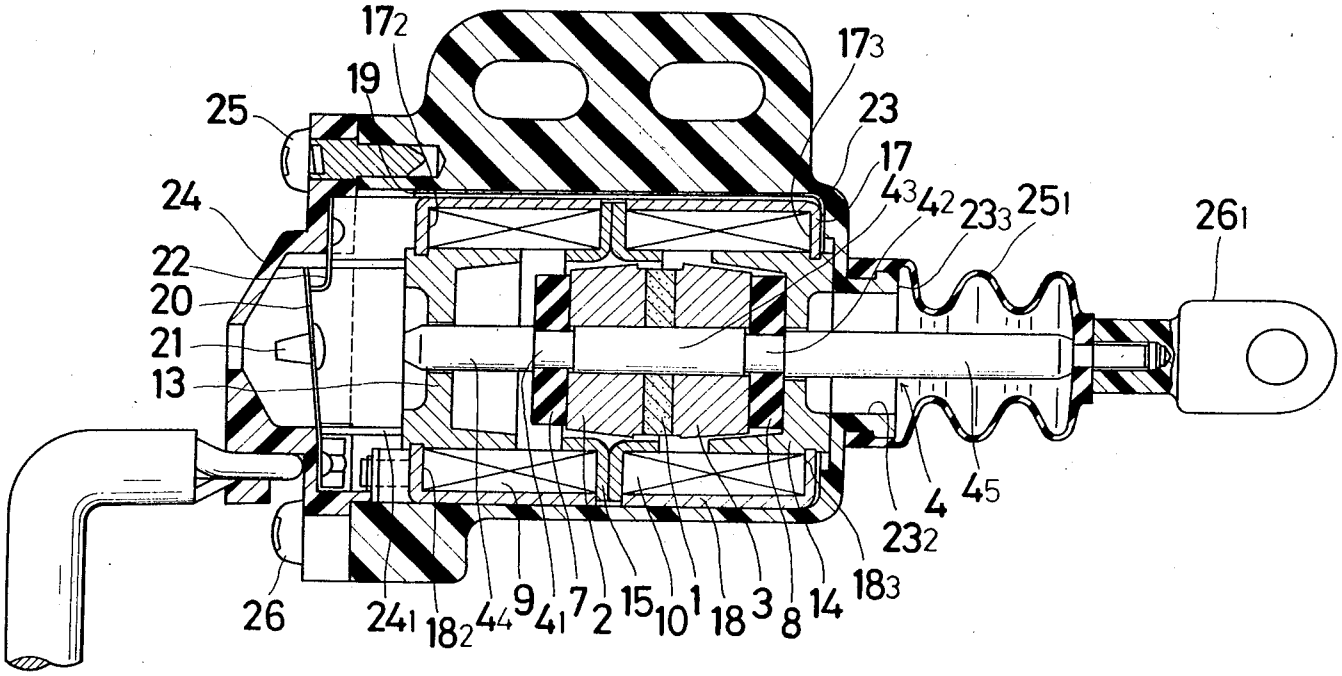
FIG. 2*a* is a longitudinal cross-sectional view of a solenoid assembly according to the present invention.
Figure 3A:
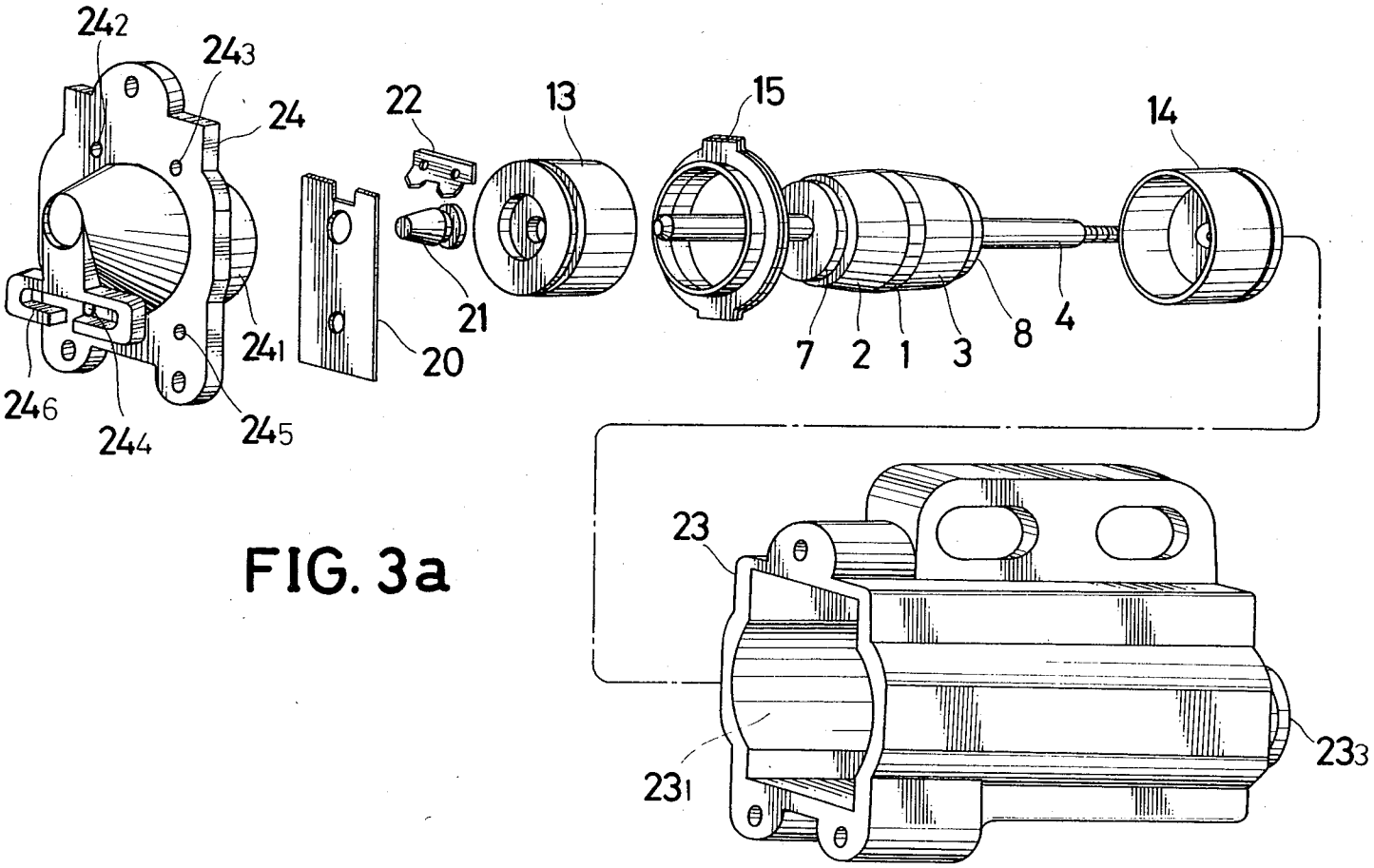
* and FIGS. 3*a,* 3*b,* and 3*c* are exploded perspective views of components of the solenoid assembly of FIG. 2*a.*
Figure 3B:
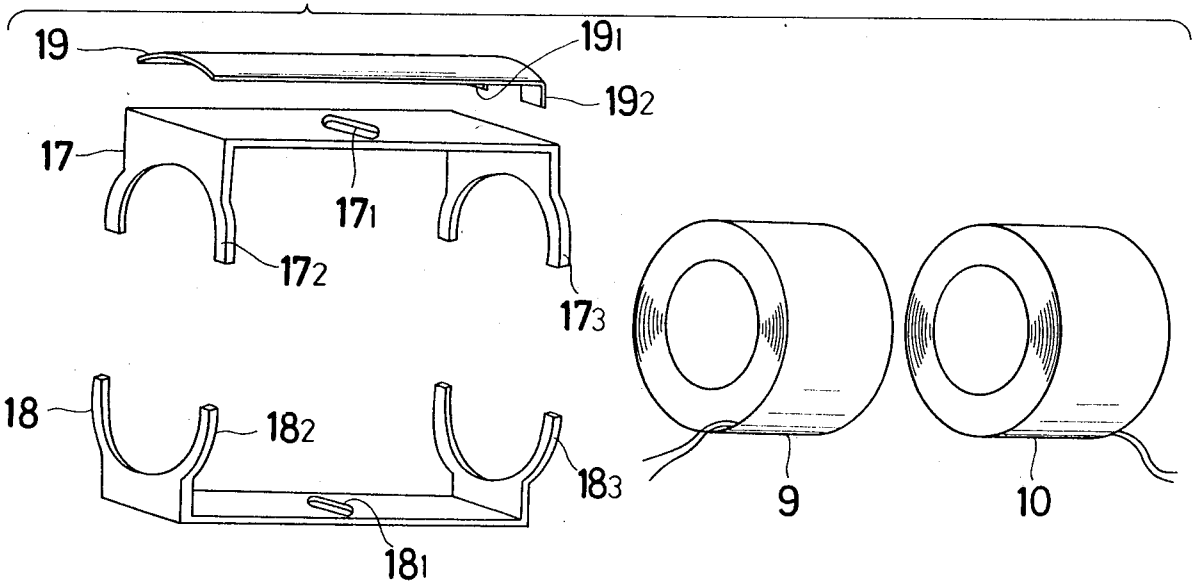
Figure 3C:
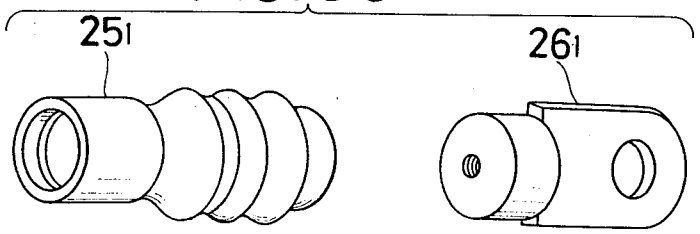

For assembly, the cup-shaped yoke end members 13, 14 are inserted into the coils 9, 10, respectively, and the shaft and plunger combination is inserted through the central plate 15 as shown in FIG. 3*a*. The shaft 4 of the shaft and plunger combination is inserted through the yoke end plates 13, 14 with the coils 9, 10 mounted thereon as shown in FIG. 2*a*. One of the projections of the central plate 15 is placed in the aperture $17_1$ in the main yoke body 17, while the other projection is placed in the aperture $18_1$ in the main yoke body 18. The locking fingers $17_2$, $18_2$ and $17_3$, $18_3$ of the main yoke bodies 17, 18 are then fitted in the annular grooves in the yoke end members 13, 14. The shaft and plunger combination (1–4, 7, 8), the yoke end members 13, 14, the central plate 15, the coils 9, 10, and the main yoke bodies 17, 18 are thus assembled together as a unitized coil and plunger combination.

The coil and plunger combination and a leaf spring 19 (FIGS. 2*a* and 3*b*) are inserted in an outer casing 23 of synthetic resin shown in FIG. 3*a*. The outer casing 23 has a space $23_1$ receptive therein of the coil and plunger combination and also has a hole $23_2$ (FIG. 2*a*) of a relatively large diameter through which the shaft 4 extends, the hole $23_2$ being defined by an axial cylindrical flange $23_3$.

As illustrated in FIG. 3*b*, the leaf spring 19 is of a curved, narrow and elongate configuration in its free state and has two bent members $19_1$, $19_2$ on one end thereof. The leaf spring 19 in its free state has a width smaller than that of a rear portion of the main yoke body 17.

The space $23_1$ in the outer casing 23 is so shaped as to accommodate therein the coil and plunger combination and the leaf spring 19 as it is kept somewhat flat. For assembling the coil and plunger combination (1–4, 7–10) into the outer casing 23, the leaf spring 19 is placed on and along the rear portion (facing upwardly in FIG. 3*b*) of the main yoke body 17 with the bent members $19_1$, $19_2$ held against an outer side surface of the locking finger $17_3$. The coil and plunger combination and the leaf spring 19 are then inserted into the space $23_1$ with the locking fingers $17_3$, $18_3$ and the bent members $19_1$, $19_2$ positioned ahead. While the leaf spring 19 is thus being inserted, it is forcibly rendered flat. After the leaf spring 19 has been inserted as shown in FIG. 2*a*, it pushes the main yoke body 17 toward the main yoke body 18 under the resilient force thereof.

The space $23_1$ in the outer casing 23 is closed off by a cover 24 of synthetic resin having an integrally molded, substantially cylindrical wall $24_1$ projecting therefrom for holding the cup-shaped yoke end member 13. The projecting wall $24_1$ is divided into two halves having a space housing a movable switch plate 20 and a fixed switch plate 22 and allowing the movable switch plate 20 to move therein. To the movable switch plate 20, there is secured a rubber piece 21 positioned for being engaged by an end (lefthand as shown in FIG. 2*a*) of the shaft 4. As illustrated in FIG. 2*a*, the switch plates 20, 22 are securely positioned within the cover 24, which is illustrated in FIG. 3*a*.

After the coil and plunger combination (1–4, 7–10) and the leaf spring 19 have been inserted in the outer casing 23, as described above, lead wires for the coils 9, 10 are threaded through lead holes $24_4$, $24_5$ in the cover 24, and then the cover 24 is secured to the outer casing 23 by screws 25 through 27. Before the cover 24 is affixed to the outer casing 23, the switch plates 20, 22 are attached to the cover 24, and lead wires are connected to the switch plates 20, 22 and drawn out of the cover 24 through lead holes $24_2$, $24_3$. The lead wires connected to the coils 9, 10 and the switch plates 20, 22 are fitted in a lead holder $24_6$ on the cover 24 as shown in FIG. 2*b*.

The switch plates 20, 22 serve to monitor the status of operation of the solenoid assembly. When the shaft and plunger combination is in a left position (shown in FIG. 2*a*), the rubber piece 21 is pushed to the left by the end of the shaft 4 to displace the switch plate 20 off the switch plate 22 (switch-off condition). When the shaft 4 is spaced from the switch plate 20 as illustrated in FIG. 2*a*, the switch plate 20 is turned clockwise under its own resiliency into contact with the switch plate 22 (switch-on condition).

The cylindrical flange $23_3$ is fitted in one end of rubber bellows $25_1$. The righthand end of the shaft 4 is inserted through a hole in the other end of the rubber bellows $25_1$. A connector $26_1$ is fixedly threaded over the exposed end of the shaft 4. Thus, the rubber bellows 25 and the connector 25 are attached to the shaft 4.

Figure 2B:
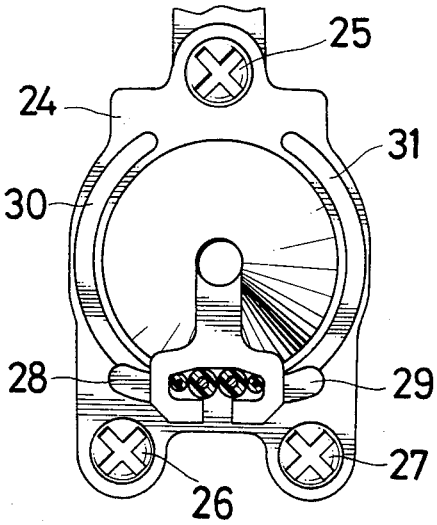
FIG. 2*b* is a side elevational view of the solenoid assembly shown in FIG. 2*a;*
Figure 2C:
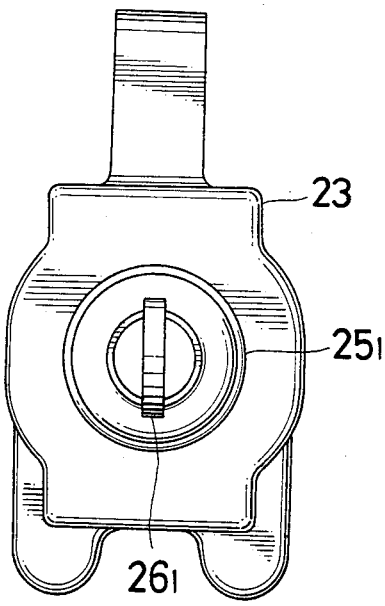

As shown in FIG. 2*b*, the lead wires connected to the coils 9, 10 are denoted by 28, 29, and the lead wires joined to the switch plates 22, 20 are denoted by 30, 31.

Operation of the solenoid assembly thus constructed according to the present invention is the same as that of the conventional solenoid assembly illustrated in FIG. 1, and will not be described here.

With the arrangement of the present invention, the plunger cores 2, 3 are held in position by the rubber disks 7, 8 engaging the shaft 4 without suffering from wobbling movement due to dimensional errors of the plunger cores 2, 3 and the permanent magnet 1. The plunger cores 2, 3 and the permanent magnet 1 can easily be coupled to the shaft 4. In the illustrated embodiment, one of the main yoke bodies 17 is urged by the leaf spring 19 to cause the yoke end members 13, 14 to be pressed against the other main yoke body 18. However, the leaf spring 19 may be dispensed with, and the main yoke bodies 17, 18 and the yoke end members 13, 14 may be dimensioned such that they will be tightly inserted in the outer casing 23. With such an alternative, the outer casing 23 should preferably be made of slightly resilient or flexible synthetic resin.

While in the foregoing embodiment the solenoid assembly has an intermediate magnetic pole (the central plate 15) and the permanent magnet 1, the present invention is equally applicable to solenoid assemblies having no such intermediate magnetic pole or no permanent magnet (for example, with a nonmagnetizable magnetic plunger being pushed in one direction by a coil spring, or with a single electric coil).

Although a certain preferred embodiment has been shown and described, it should be understood that many changes and modifications may be made therein without departing from the scope of the appended claims.

What is claimed is:

1. A solenoid assembly comprising:

(a) a magnetic plunger;

(b) an electric coil for generating a magnetic flux in a direction along an axis of said magnetic plunger;

(c) a main yoke composed of at least two separate substantially identical members diametrically opposed relative to said plunger for defining a magnetic flux passage around said electric coil;

(d) a pair of yoke end members held in engagement respectively with opposite ends of said main yoke;

(e) an outer casing;

(f) one of said main yoke and said yoke end members having recesses extending substantially normally to said axis of said magnetic plunger, with the other having projections fitted respectively in said recesses to maintain said main yoke and said yoke end members in engaging relationship; and (g) said outer casing having an inner wall keeping said main yoke held in engagement with said yoke end members.

2. A solenoid assembly according to claim 1, wherein said projections comprise locking fingers bent at a right angle from the opposite ends of a longitudinal portion of said main yoke in the axial direction of said coil, and defining partially circular openings, said recesses comprising annular grooves defined in peripheral surfaces of said yoke end members in circumferential alignment with said circular openings.

3. A solenoid assembly according to claim 1, wherein said main yoke comprises two separate members, said projections comprising locking fingers bent at a right angle from the opposite ends of a longitudinal portion of said main yoke in the axial direction of said coil, and defining partially circular openings, said recesses comprising annular grooves defined in peripheral surfaces of said yoke end members in circumferential alignment with said circular openings.

4. A solenoid assembly according to claim 3, wherein said main yoke has a longitudinally central aperture, said magnetic plunger comprising a permanent magnet, a pair of magnetic cores sandwiching said permanent therebetween, and a shaft on which said permanent magnet and magnetic cores are fixedly mounted, said electric coil comprising a pair of electric coils one disposed between a central plate having a portion inserted in said longitudinally central aperture and one of said locking fingers, and the other between said central plate and the other locking finger.

5. A solenoid assembly comprising:

(a) a magnetic plunger;

(b) an electric coil for generating a magnetic flux in a direction along an axis of said magnetic plunger;

(c) a main yoke composed of at least two separate members for defining a magnetic flux passage around said electric coil;

(d) a pair of yoke end members held in engagement respectively with opposite ends of said main yoke;

(e) an outer casing;

(f) spring means disposed in said outer casing for normally pushing at least one of said two separate members toward the other separate member;

(g) one of said main yoke and said yoke end members having recesses extending substantially normally to said axis of said magnetic plunger, with the other having projections fitted respectively in said recesses to maintain said main yoke and said yoke end members in engaging relationship; and (g) said spring means imposing a force on said main yoke to keep the latter held in engagement with said yoke end members.

6. A solenoid assembly according to claim 5, wherein said projections comprise locking fingers bent at a right angle from the opposite ends of a longitudinal portion of said main yoke in the axial direction of said coil, and defining partially circular openings, said recesses comprising annular grooves defined in peripheral surfaces of said yoke end members in circumferential alignment with said circular openings.

7. A solenoid assembly according to claim 5, wherein said main yoke comprises two separate members, said projections comprising locking fingers bent at a right angle from the opposite ends of a longitudinal portion of said main yoke in the axial direction of said coil, and defining partially circular openings, said recesses comprising annular grooves defined in peripheral surfaces of said yoke end members in circumferential alignment with said circular openings.

8. A solenoid assembly according to claim 5, wherein said spring means comprises a leaf spring curved in its free state and disposed forcibly flatwise in a gap between said inner wall of said outer casing and a back of one of said two separate members of said main yoke.

9. A solenoid assembly according to claim 7, wherein said main yoke has a longitudinally central aperture, said magnetic plunger comprising a permanent magnet, a pair of magnetic cores sandwiching said permanent therebetween, and a shaft on which said permanent magnet and magnetic cores are fixedly mounted, said electric coil comprising a pair of electric coils one disposed between a central plate having a portion inserted in said longitudinally central aperture and one of said locking fingers, and the other between said central plate and the other locking finger.

10. A solenoid assembly according to claim 7, wherein said magnetic plunger comprises a permanent magnet, a pair of magnetic cores sandwiching said permanent magnet therebetween, a shaft, and resilient members, said shaft extending through holes in said permanent magnet and said resilient member and having recesses defined in outer peripheral surface thereof in the vicinity of said magnetic cores, said resilient members having portions engaging in said recesses and portions held against sides of said magnetic cores to push said magnetic cores against said permanent magnet.

11. A solenoid assembly comprising:

(a) a magnetic plunger;

(b) an electric coil for generating a magnetic flux in a direction along an axis of said magnetic plunger;

(c) main yoke composed of at least two separate substantially identical members diametrically opposed relative to said plunger for defining a magnetic flux passage around said electric coil;

(d) a pair of yoke end plates having cylindrical projections held in engagement respectively with ends of said main yoke;

(e) an outer casing;

(f) said yoke end members having recesses extending substantially normally to said axis of said magnetic plunger, said main yoke having projections fitted respectively in said recesses to maintain said main yoke and said yoke end members in engaging relationship; and (g) said electric coil being disposed radially outwardly of said cylindrical projections of said yoke end members and between projections of said main yoke at the ends thereof.

12. A solenoid assembly according to claim 11, wherein said projections comprise locking fingers bent at a right angle from the opposite ends of a longitudinal portion of said main yoke in the axial direction of said coil, and defining partially circular openings, said recesses comprising annular grooves defined in peripheral surfaces of said yoke end members in circumferential alignment with said circular openings.

13. A solenoid assembly according to claim 11, wherein said main yoke comprises two separate members, said projections comprising locking fingers bent at a right angle from the opposite ends of a longitudinal portion of said main yoke in the axial direction of said coil, and defining halves of circular openings, said recesses comprising annular grooves defined in peripheral surfaces of said yoke end members in circumferential alignment with said circular openings.

14. A solenoid assembly according to claim 11, wherein said electric coil comprises a fixedly shaped coil composed of an insulated wire coated with thermally fusible insulating material and wound into a coil, which is heated and fused.

15. A solenoid assembly according to claim 13, wherein said main yoke has a longitudinally central aperture, said magnetic plunger comprising a permanent magnet, a pair of magnetic cores sandwiching said permanent therebetween, and a shaft on which said permanent magnet and magnetic cores are fixedly mounted, said electric coil comprising a pair of electric coils one disposed between a central plate having a portion inserted in said longitudinally central aperture and one of said locking fingers, and the other between said central plate and the other locking finger, said central plate having annular projections supporting said coils.

16. A solenoid assembly according to claim 13, wherein said magnetic plunger comprises a permanent magnet, a pair of magnetic cores sandwiching said permanent magnet therebetween, a shaft, and resilient members, said shaft extending through holes in said permanent magnet and said resilient member and having recesses defined in outer peripheral surface thereof in the vicinity of said magnetic cores, said resilient members having portions engaging in said recesses and portions held against sides of said magnetic cores to push said magnetic cores against said permanent magnet.

17. A solenoid assembly comprising:

(a) a permanent magnet having a hole and magnetized in a direction along a central axis of said hole (b) a pair of magnetic cores having holes and disposed on the sides of N and S poles of said permanent magnet;

(c) a shaft extending through said holes in said permanent magnet and said magnetic cores and having recesses adjacent to outer sides of said magnetic cores;

(d) resilient members having portions engaging in said recesses and portions held against sides of said magnetic cores to push the latter against said permanent magnet;

(e) an electric coil for generating a magnetic flux in a direction along said shaft; and (f) a yoke for defining a magnetic flux passage around said electric coil.

18. A solenoid assembly according to claim 17, wherein said recesses comprise annular slots extending circumferentially around said shaft.

19. A solenoid assembly according to claim 18, wherein said resilient members have holes of a diameter smaller than that of other portions of said shaft than said slots, said holes in said resilient members being positioned in said slots in said shaft.

* * * * *